United States Patent [19]

Welzel

[11] 3,987,634

[45] Oct. 26, 1976

[54] ROOF-SUPPORTING ARRANGEMENT

[75] Inventor: Josef Welzel, Wuppertal, Germany

[73] Assignee: Hermann Hemscheidt Maschinenfabrik, Bornberg, Germany

[22] Filed: Feb. 13, 1976

[21] Appl. No.: 657,938

[30] Foreign Application Priority Data

Feb. 18, 1975 Germany ..... 2506779

[52] U.S. Cl. ..... 61/45 D

[51] Int. Cl.[2] ..... E21D 15/44

[58] Field of Search ..... 61/45 D, 63; 299/31, 299/33; 248/357; 91/170 MP

[56] References Cited

UNITED STATES PATENTS

| | | | |
|---|---|---|---|
| 2,644,311 | 7/1953 | Malloy | 61/45 D |
| 3,376,707 | 4/1968 | Dommann | 61/45 D |
| 3,490,243 | 1/1970 | Groetschel | 61/45 D |
| 3,525,227 | 8/1970 | Handcock et al. | 61/45 D |

FOREIGN PATENTS OR APPLICATIONS

| | | | |
|---|---|---|---|
| 1,325,840 | 3/1963 | France | 61/45 D |
| 1,533,176 | 6/1968 | France | 61/45 D |
| 1,125,381 | 3/1962 | Germany | 61/45 D |

*Primary Examiner*—Dennis L. Taylor
*Attorney, Agent, or Firm*—Berman, Aisenberg & Platt

[57] ABSTRACT

A mine roof-supporting arrangement comprising a series of assemblies each comprising a cross beam, three shield-type roof-supporting units, and a pair of rams, a center one of said three units being directly secured to the cross beam, and the other two (i.e. outer) units being secured to the cross beam via respective ones of said rams so that each outer unit may be aligned with or trail behind its corresponding center unit depending upon the position of its respective ram, wherein each assembly is arranged (in the normal roof-supporting position of the assemblies) with that one of its outer units which is adjacent a next trailing assembly being so disposed as to trail behind its corresponding center unit and the other outer unit whereby to protect from waste the adjacent outer unit of said next trailing assembly.

6 Claims, 6 Drawing Figures

ROOF-SUPPORTING ARRANGEMENT

This invention relates to a roof-supporting arrangement for a mine composed of a number of roof-supporting assemblies disposed beside one another along the face being worked, each roof-supporting assembly comprising three shield-type units disposed side-by-side with the centre unit being firmly attached to a cross beam and the two outer units each being anchored to the cross beam by a ram.

Such shield type units generally comprise a base member or sleeper which rests on the mine floor, a supporting arm pivotally connected at its lower end to the sleeper and at its upper end to a roof-supporting plate, and an hydraulic jack acting between the sleeper and the supporting arm to raise the support arm and thus brace the support plate against the roof.

A roof-supporting assembly comprising three such shield units connected to a cross beam is described in detail in German Offenlegungsschrift No. 23 37 218 which was published in the German Federal Republic on Feb. 6, 1975, and the precise construction of the assembly will not therefore be described in detail in this Specification. The manner in which that form of assembly is advanced is as follows: The three shield-type units are initially in positions where they are aligned with one another. In this position the jack of the centre unit is lowered so that its roof-supporting plate is lowered away from the roof, and the rams on the two outer shield units are then extended so that the centre unit is advanced. The jack on the centre unit is then once more raised so that the centre unit once more supports the roof. The two outer units are then in turn pulled up level with the centre unit by lowering their respective jacks, contracting their rams, and once more extending their jacks. When the face being worked is inclined with respect to the horizontal, the lowermost outer unit (i.e. the unit on the dip side) is first pulled up level with the centre unit, and the other outer unit (i.e. the unit on the rise side) is subsequently pulled up level with the centre unit. Thus, after each advancing step, the three units of each assembly are aligned with one another.

The above-described assemblies may be used in back-sloping seams, i.e. seams where the face being worked is not perpendicular to the direction of advance, in which case the assemblies of three units are not aligned with one another but are progressively staggered, the assembly on the side of the rise leading, and the assembly on the side of the dip trailing. This, however, can give rise to difficulty when the assemblies are advanced. Usually, in steeply inclined seams, the assemblies are advanced consecutively from the dip to the rise, which means that the side of the outer unit on the dip side of an assembly is exposed to the pressure of the waste when the centre unit of the assembly is advanced. This must be prevented in order to prevent the assemblies being pushed over by the pressure of the waste material, and for this reason additional shielding means are needed, particularly since the unit to be advanced is always that furthest away from the longwall face.

It is an object of the present invention to provide an arrangement of roof supporting assemblies of the shield type having three units in each assembly, which arrangement is suitable for use in steeply inclined seams at back sloping faces without having the above described shortcomings which necessitate the use of additional shielding means.

A roof-supporting arrangement according to the invention accordingly comprises a series of roof-supporting assemblies disposed generally side-by-side along a face being worked but being progressively staggered one behind another, each said assembly comprising a cross beam, three shield-type roof-supporting units, and a pair of rams, a centre one of said three units being directly secured to the cross beam, and the other two (i.e. outer) units being secured to the cross beam via respective ones of said rams so that each outer unit may be aligned with or trail behind its corresponding centre unit depending upon the position of its respective ram, wherein each assembly is arranged (in the normal roof-supporting position of the assemblies) with that one of its outer units which is adjacent a next trailing assembly being so disposed as to trail behind its corresponding centre unit and the other outer unit whereby to protect from waste the adjacent outer unit of said next trailing assembly.

A roof-supporting arrangement according to the invention will be disposed generally parallel (though stepped) to a back-sloping coal face and presents a closed surface to the waste. Where the seam is inclined to the horizontal, the units of each assembly will be advanced in turn from the unit adjacent the dip to the unit adjacent the rise.

An example of a roof-supporting arrangement according to the invention is shown in the accompanying drawings, in which.

Figure 1:
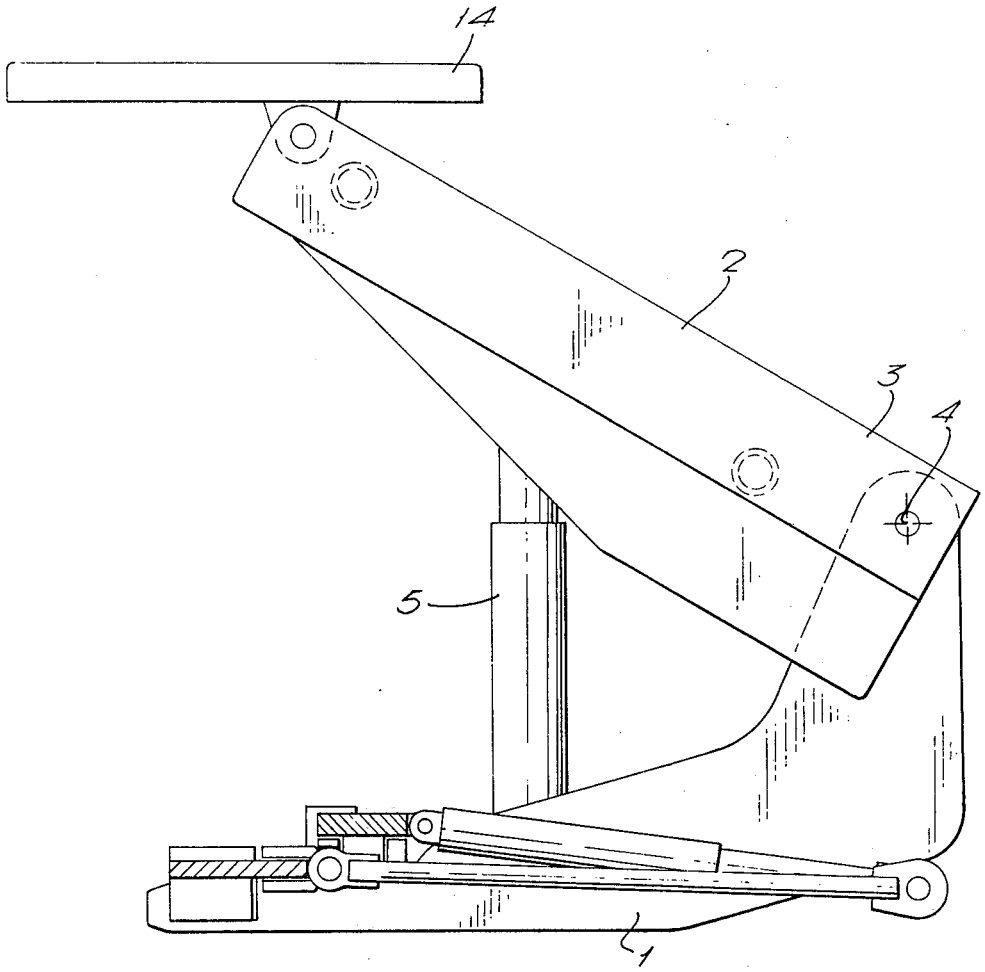
FIG. 1 is a copy of FIG. 3 in German Offenlegungsschrift No. 23 37 218 referred to above to illustrate the construction of the individual roof supporting units.
Figure 2:
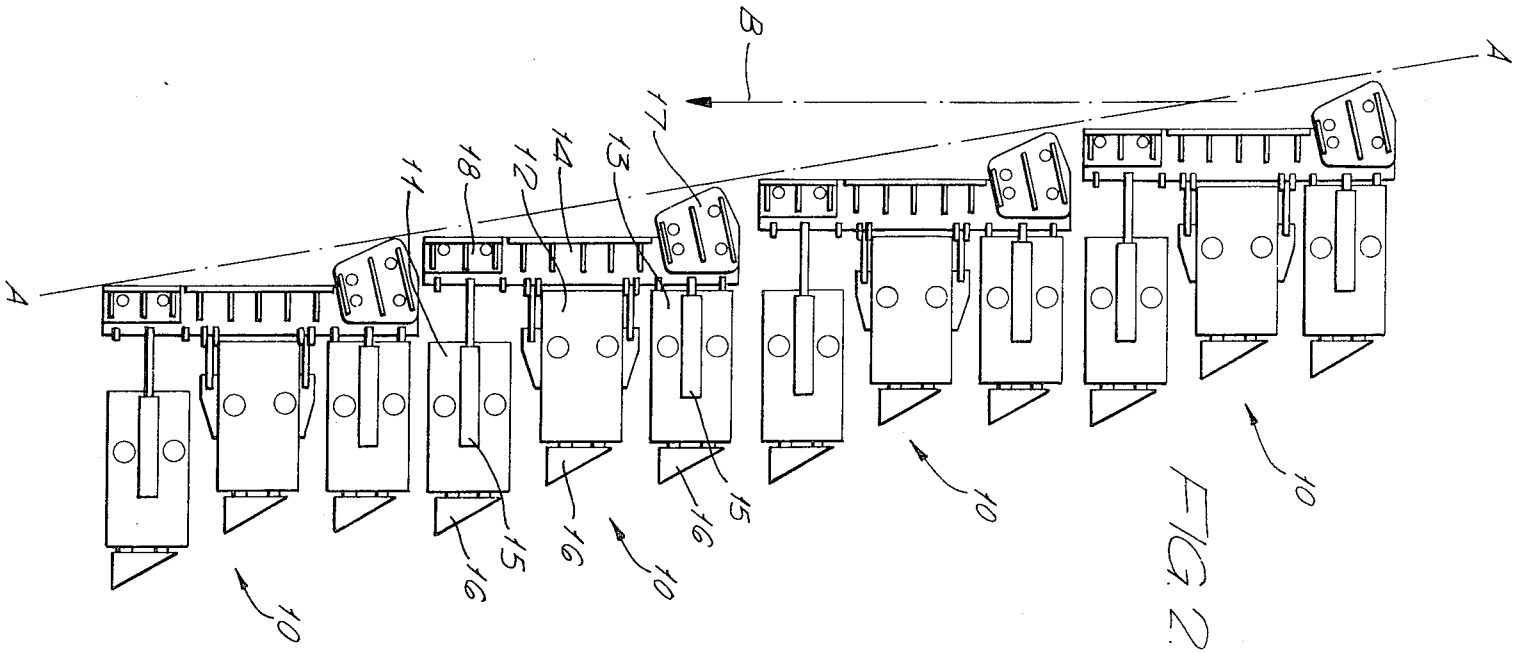
FIG. 2 is a plan view of a roof-supporting arrangement according to the invention, in which the roof supporting assemblies are progressively staggered one behind the other from the rise towards the dip of an inclined coal seam.

FIG. 2 shows in plan view a roof-supporting arrangement comprising four roof supporting assemblies 10. Each assembly 10 comprises three roof supporting units 11, 12 and 13 of the shield type substantially as shown in FIG. 1 and described in greater detail in German Offenlegungsschrift No. 23 37 318. It is sufficient to say here that each such unit comprises a base member or sleeper 1 which rests on the mine floor, a supporting arm 2 pivotally connected at its lower end 3 to the sleeper 1 by a pivot 4, and an hydraulic jack 5 acting between the sleeper 1 and the supporting arm 2 to raise the latter and thus brace a roof-support beam 14 against the mine roof. In the arrangement of the present invention, however, the two outer units 11 and 13 of each assembly are connected to the beam 14 by double acting rams 15 (see FIG. 2) which are operable to enable each unit of an assembly 10 to be advanced by hydraulic pressure. In other words, only the centre unit of each assembly is pivotally connected direct to the beam 14. In addition, each of the units 11 to 13 is fitted with a waste diverter 16 which serves to prevent loose rock from the waste entering the space beneath the units.

In FIG. 2 the angle or backslope of the face being worked is indicated by the line A—A, while the direction of the dip is indicated by arrow B. The assemblies 10 are staggered one behind the other, the assembly 10 nearest to the rise leading, whilst the assembly nearest to the dip trails. The amount of stagger is such that the cross beam 14 of each assembly 10 trails the cross beam 14 of the next adjacent assembly on the rise side by one step, i.e. the amount that each ram 15 can extend or contract. The amount of stagger of course corresponds with the angle of backslope of the coal face.

With the arrangement illustrated, the unit 13 of each assembly 10 (i.e. the unit nearest the rise) and the central unit 12 are roughly level with the unit 11 on the next adjacent assembly 10 towards the rise. In other words, the unit 11 of each group is not drawn up level with the other units as was the case in the prior art, but is instead left trailing to protect the next adjacent unit 11 towards the dip.

In order to bridge the gap between the cross beam regions of adjacent assemblies 10, a bridging platform 17 is mounted on that end of each cross beam 14 which is nearest the rise, i.e. adjacent the next leading assembly 10. The bridging platform 17 is designed to be interchanged with a corresponding section 18 at the other end of each beam 14 in case the direction of dip should change at different regions along the face.

Figure 3:
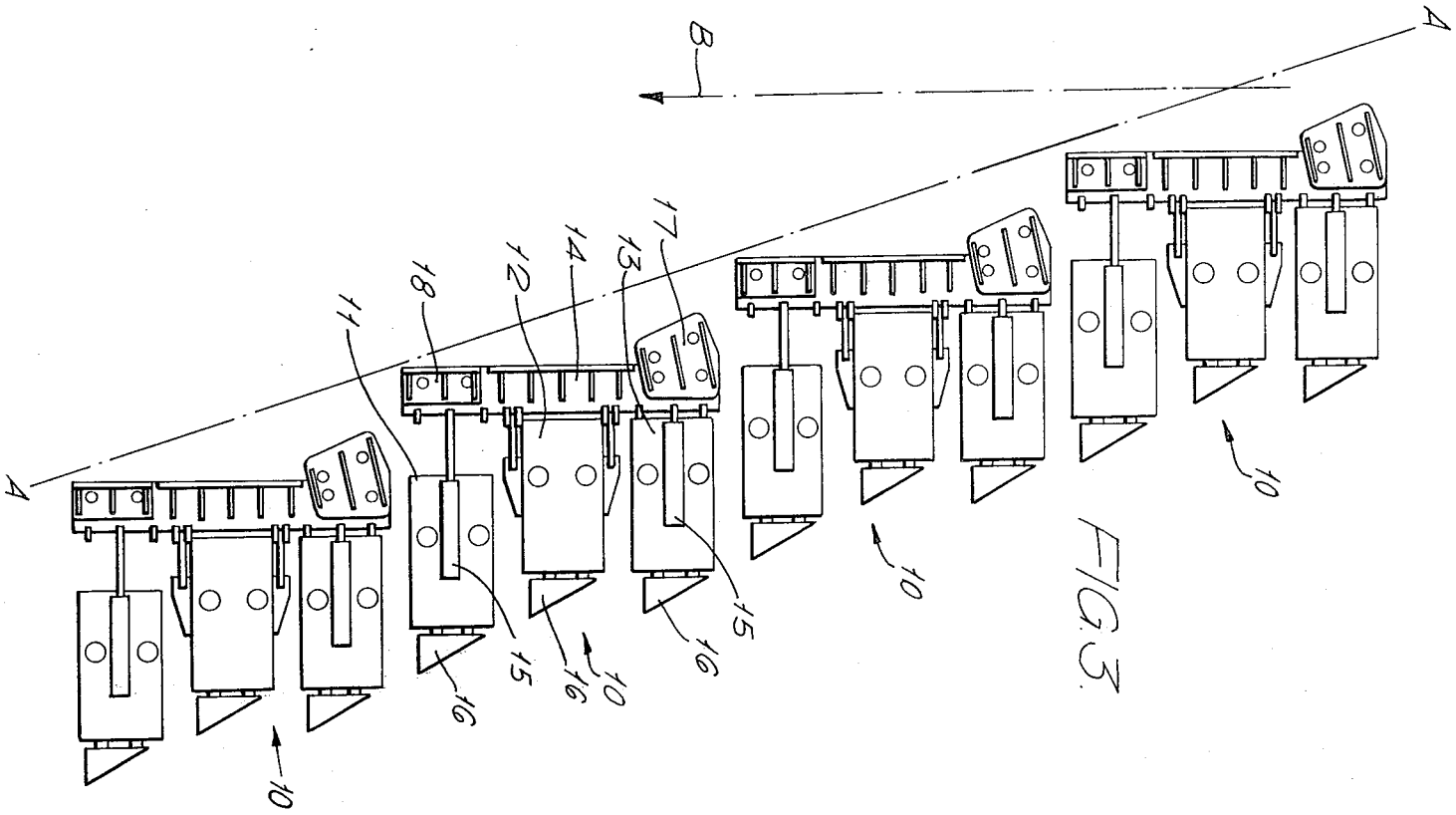
FIG. 3 is a view of an arrangement similar to that of FIG. 2, but in which the stagger, i.e. the distance between adjacent assemblies, is greater.

In FIG. 3 the backslope of the face is greater and the dip is correspondingly steeper. The stagger of adjacent assemblies 10 is therefore greater also. In this case the stagger between adjacent cross beams 14 is two steps, i.e. twice the extension or contraction provided by a ram 15. For this reason, each trailing unit 11 is not level with an adjacent unit 13 on a next trailing assembly, but instead leads it slightly.

Figure 4C:
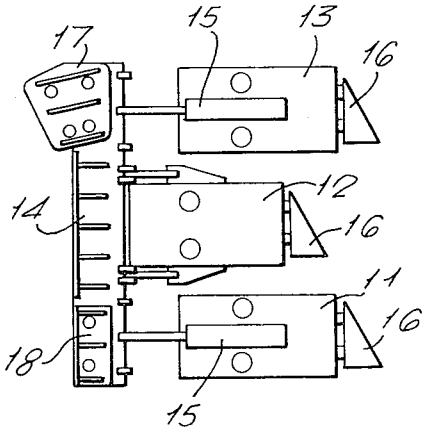
FIG. 4 comprises three views A, B and C illustrating progressively the manner in which the three roof-supporting units of a roof supporting assembly are advanced.
Figure 4B:
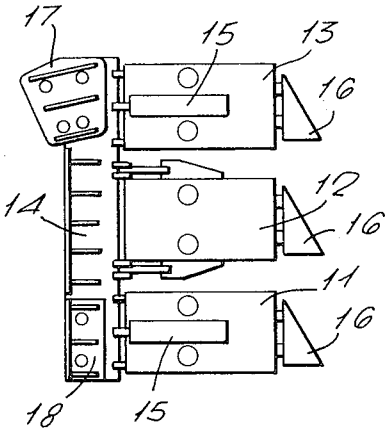
Figure 4A:
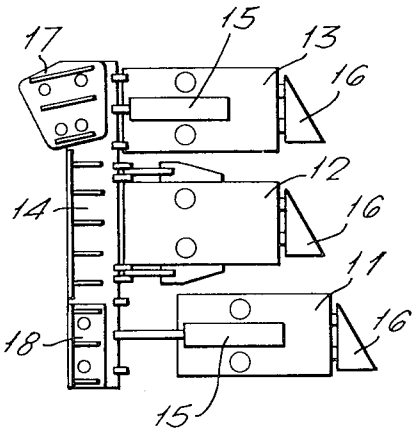

View A of FIG. 4 shows the three units 11, 12 and 13 of an assembly 10 in the positions which they normally occupy, with the unit 11 trailing. In order to advance an assembly 10, the trailing unit 11 is first pulled up to the other units by means of the ram 15 (view B). The two outer units are then braced against the roof whilst the unit 12 is lowered from the roof and advanced by extending both rams 15 (view C). The unit 13 adjacent the rise is then drawn up level with the central unit (view A). The next unit to be advanced will be the next adjacent unit 11 of a next adjacent leading assembly 10.

An important advantage of the roof-supporting arrangement described above is that it continues to present a closed face to the waste as each unit is advanced because each unit is advanced within the range shielded by the next adjacent unit towards the rise. Consequently, special waste end and side screens and supplementary stabilising equipment can be dispensed with.

What is claimed is:

1. A roof-supporting arrangement for a mine comprising a series of roof-supporting assemblies disposed generally side-by-side along a face being worked but being progressively staggered one behind another, each said assembly comprising a cross beam, three shield-type roof-supporting units, and a pair of rams, a centre one of said three units being directly secured to the cross beam, and the other two (i.e. outer) units being secured to the cross beam via respective ones of said rams so that each outer unit may be aligned with or trail behind its corresponding centre unit depending upon the position of its respective ram, wherein each assembly is arranged (in the normal roof-supporting position of the assemblies) with that one of its outer units which is adjacent a next trailing assembly being so disposed as to trail behind its corresponding centre unit and the other outer unit whereby to protect from waste the adjacent outer unit of said next trailing assembly.

2. A roof-supporting arrangement as claimed in claim 1, in which said face is back-sloping and inclined to the horizontal, and in which the leading one of the roof-supporting assemblies is disposed towards the rise of the face.

3. A roof-supporting arrangement as claimed in claim 1, in which said outer unit which trails the other two units of the same assembly is disposed level with the said adjacent unit of the said next trailing assembly which it protects.

4. A roof-supporting arrangement as claimed in claim 1, in which a bridging platform is mounted on each said cross beam, said bridging platform serving to at least partially bridge the gap between adjacent assemblies, which gap results from the staggering of adjacent assemblies.

5. A roof-supporting arrangement as claimed in claim 4, in which said face is inclined to the horizontal and in which said bridging member is disposed on that end of a cross beam adjacent the rise.

6. A roof-supporting arrangement according to claim 5, in which said bridging platform is designed to be interchanged with a section mounted at the end of the cross beam remote from the said bridging platform.

* * * * *